US005370707A

United States Patent [19]

Sando et al.

[11] Patent Number: 5,370,707

[45] Date of Patent: Dec. 6, 1994

[54] METHOD FOR BLEACHING CLOTH

[75] Inventors: Yoshiteru Sando; Eiichi Nakano; Hiroshi Ishidoshiro; Koji Sando, all of Wakayama, Japan

[73] Assignee: Sando Iron Works Co., Ltd., Wakayama, Japan

[21] Appl. No.: 672,375

[22] Filed: Mar. 20, 1991

[30] Foreign Application Priority Data

| | | | |
|---|---|---|---|
| Mar. 28, 1990 | [JP] | Japan | 2-79693 |
| May 16, 1990 | [JP] | Japan | 2-125880 |
| May 16, 1990 | [JP] | Japan | 2-125881 |
| Jul. 10, 1990 | [JP] | Japan | 2-181986 |
| Sep. 19, 1990 | [JP] | Japan | 2-249218 |
| Sep. 19, 1990 | [JP] | Japan | 2-249220 |

[51] Int. Cl.[5] ..... D06L 3/06

[52] U.S. Cl. ..... 8/108.1; 8/104; 8/116.4; 8/149.2

[58] Field of Search ..... 8/108.1, 116.4, 149.2, 8/109

[56] References Cited

U.S. PATENT DOCUMENTS

| | | | |
|---|---|---|---|
| 2,900,219 | 8/1959 | Waibel | 8/108.1 |
| 2,944,872 | 7/1960 | Vermijs | 8/108.1 |
| 3,120,424 | 2/1964 | Ruedi | 8/108.1 |
| 4,643,736 | 2/1987 | Cholley | 8/108.1 |
| 5,228,884 | 7/1993 | Ceaven et al. | 8/108.1 |

FOREIGN PATENT DOCUMENTS

| | | |
|---|---|---|
| 49-096982 | 9/1974 | Japan . |
| 2133659 | 5/1990 | Japan . |

OTHER PUBLICATIONS

Kirk-othmer *Encyclopedia of Chemical Technology* Third Edition vol. 3 John Wiley & Sons NY 1978, pp. 938–950. (no month available).

*Primary Examiner*—Prince Willis, Jr.
*Assistant Examiner*—James M. Silberman
*Attorney, Agent, or Firm*—McAulay Fisher Nissen Goldberg & Kiel

[57] ABSTRACT

A method for bleaching a cloth comprising subjecting a cloth soaked with an aqueous bleaching solution comprising sodium chlorite to wet heat treatment at a temperature nearly to 100° C., particularly subjecting a long cloth soaked with the bleaching solution to wet heat treatment continuously in an ordinary pressure wet heat treating chamber of which atmosphere being acidified to a pH of 3–4 by the use of an activation agent for making the atmosphere containing sodium chlorite acidic comprising an inorganic acid such as sulfuric acid and hydrochloric acid, an organic acid such as formic acid and acetic acid, and a carbonyl compound such as formaldehyde and acetaldehyde so as to form chlorine dioxide active for the bleaching of a cloth by the decomposition of sodium chlorite, and apparatuses for carrying out the method.

5 Claims, 4 Drawing Sheets

METHOD FOR BLEACHING CLOTH

BACKGROUND OF THE INVENTION

1. Field of the Invention

The present invention relates to a method for bleaching a long cloth continuously, with particular in tension to give an excellent result in saving energy, and an apparatus therefor.

2. Description of the Related Art

In a conventional method for bleaching a long cloth produced industrially with the use of sodium chlorite, an aqueous bleaching solution comprising sodium chlorite together with an organic acid such as formic acid and acetic acid or an inorganic acid such as phosphoric acid and sulfuric acid, is applied to a cloth to be bleached at tile ordinary temperature, and the resultant cloth is subjected to wet heat treatment in a treating chamber in gaseous or liquid medium for carrying out the bleaching treatment in object continuously.

To describe said method for bleaching a long cloth continuously for practical use in detail, the pH of the aqueous treating solution is controlled to 3–4, and after the cloth is soaked with said bleaching solution at the ordinary temperature by transporting the cloth continuously therethrough, the cloth is squeezed by using a squeeze roll in order to render its solution content appropriate (about 100%), and then the resultant cloth is transported through a bleaching chamber in gaseous or liquid medium continuously. In the bleaching chamber, the cloth is folded to form piles in succession, and subjected to the bleaching at a temperature in the range of 80°–90° C. for about 40–60 minutes. After a sufficient treating time, the piles of the thus treated cloth are taken out of the chamber in succession, and thus the continuous bleaching of a long cloth is ended.

However, in such an instance, since the cloth is piled in succession in this way, the temperature distribution of the interior and the outside of the cloth thus piled is not uniform, and the temperature of the interior of the pile is unavoidably low. Accordingly, the reaction velocity, i.e., the bleaching speed, is low at the interior of the piles. This is the reason why it needs a long time of about 40–60 minutes as above mentioned in order to complete the bleaching up to the interior of the piles sufficiently. Moreover, since the treating degree differs place after place, uniformly bleached product can hardly be obtained, and further, since the treating time is unavoidably long as above mentioned, it is unavoidable that creases are formed in the cloth due to folding, particularly at the bottom part of the piles owing to the weight of the cloth itself. The formation of creases is especially remarkable in a high density cloth and the one with a fine yarn number.

Separately, to avoid the defect of forming piles of cloth, in bleaching a long cloth continuously, a method has been proposed to transport a cloth to be bleached continuously through a wet heat treating chamber with no tension continuously by using a plurality of guide rolls or a piler. However, since it needs a long treating time of about 40–60 minutes thereby for the bleaching of each part of a long cloth uniformly, the length of the cloth staying in a chamber becomes unavoidably very long, and accordingly the number of guide rolls necessary for transporting the cloth continuously becomes very numerous and the size of the piler becomes very large. In calculating, for trial, the length of a cloth necessary to stay in the wet heat treating chamber under the condition that the passing speed of a cloth therethrough is 100 m/min as usual in the similar treatment in a wet heat treating chamber, the length of the cloth staying in the treating chamber becomes unavoidably very long as 4,000–6,000 meters when the bleaching time is so long as 40–60 minutes as in the above-mentioned case. Therefore, it is obvious that such a proposal is by no means practical.

SUMMARY OF THE INVENTION

Under such circumstances, the present inventors have recently filed Japanese Patent Application Nos. Hei 2-125880 and Hei 2-125881 on this matter, and the present invention is a continuation of them.

The technical thought of the present invention is based on the consideration that, when the reaction time of bleaching a cloth with the use of an aqueous sodium chlorite solution can be shorten, it may be possible to apply the method of transporting a cloth continuously in a wet heat treating chamber by using limited number of guide rolls on a small size piler, with which the defect of the formation of creases in the cloth as in the case of piling the cloth as above mentioned can be prevented. Accordingly, the essential point of the present invention is to shorten the reaction time of bleaching a cloth with the use of sodium chlorite as a bleaching agent in a wet heat treating chamber remarkably by improving the means for applying the bleaching agent to the cloth.

As a method for shortening the treating time in the bleaching of a cloth with the use of a sodium chlorite solution, such means can be considered as to lower the pH of the treating solution, to use a concentrated treating solution, to use a large quantity of the treating solution, to elevate the treating temperature and so on. However, in any one of these means, it is impossible to shorten the bleaching time sufficiently low, for instance, to 2 minutes. It needs at least about 10 minutes thereby.

Differing from these considerations, the principle of shortening the bleaching time of a cloth in using sodium chlorite in the present invention is to make the atmosphere of the wet heat treating chamber acidic with the use of an activation agent for making the atmosphere containing sodium chlorite acidic. The term will frequently be called in short as "activation agent" hereinafter. In an acidic atmosphere, sodium chlorite ($NaClO_2$) is decomposed at a sufficiently high temperature, via free chlorous acid ($HClO_2$), to form chlorine dioxide ($ClO_2$), and indeed, chlorine dioxide is effective for the bleaching of a cloth and others due to the effect of oxidation.

As the preferred embodiments of the present inventive method will be described together with the apparatuses thereof in detail in the following, it is proved thereby that, in such a condition, the bleaching of a cloth with the use of an aqueous sodium chlorite solution can be done satisfactorily in a very short time of 30–60 seconds or at least in 2 minutes at a temperature within 100° C. Therefore, it becomes possible to carry out the continuous bleaching of a long cloth for practical use in a small size ordinary pressure wet heat treating chamber fitted with a limited number of guide rolls or a small size piler for transporting a long cloth with no tension continuously therethrough in a short time satisfactorily and effectively by eliminating the defect of folding the cloth to form piles in the conventional art as above mentioned.

As an activation agent for making the atmosphere containing sodium chlorite acidic so as to form chlorine dioxide from sodium chlorite in this instance, an inorganic acid such as sulfuric acid and hydrochloric acid, an organic acid such as formic acid and acetic acid, and further, a carbonyl compound such as formaldehyde and acetaldehyde can satisfactorily be used.

In this connection, as already mentioned, an inorganic or organic acid is added to a sodium chlorite solution also in said prior art, However, its addition is done at the ordinary temperature prior to the bleaching. Therefore, it is considered that, while such an acid is effective to decompose sodium chlorite to form chlorine dioxide at the ordinary temperature, the thus formed chlorine dioxide has no effect to bleach a cloth and escapes in vain in such a cold state, and even when the thus treated mixture is subjected to the bleaching of a cloth at a higher temperature in the range of 80°–90° C. as in said prior art, no satisfactory bleaching can be done in a short time.

As above mentioned, it is possible in the present invention to perform the continuous bleaching of a long cloth by using a small size wet heat treating chamber and by eliminating the defects in the prior art. Accordingly, the product thus obtained is quite excellent, particularly having no such defect as the creases of which formation can by no means be avoided in the conventional art. Thus, the effect of the present invention is quite distinguished.

BRIEF DESCRIPTION OF THE DRAWINGS

Finally.

DETAILED DESCRIPTION OF THE PREFERRED EMBODIMENTS

Figure 1:
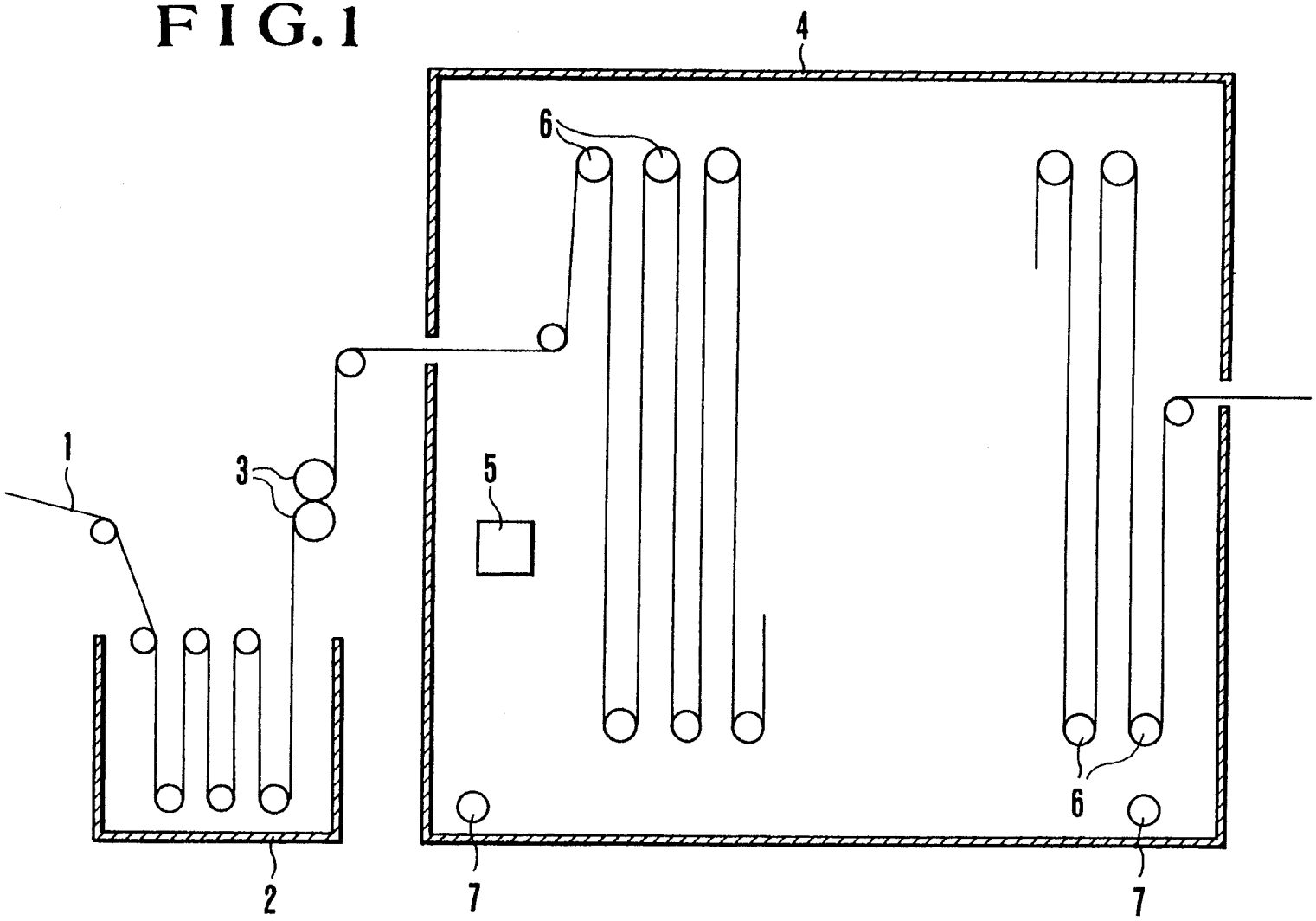
FIG. 1 is an example of the present inventive apparatus in general for bleaching a long cloth continuously in the present invention by using an ordinary pressure wet heat treating chamber fitted with a plurality of guide rolls for transporting the cloth.

The examples of the preferred embodiment of the invention will be described in detail in the following with reference to the examples of the inventive apparatus in the drawings.

EXAMPLE 1

In FIG. 1, 1 is a long cloth, for instance, a cotton cloth or a blended yarn cloth containing cotton, to be bleached. 2 is a bleaching solution tank in which sodium chlorite solution is to be introduced at the ordinary temperature. 3 is a squeeze roll for squeezing the cloth soaked with the bleaching solution appropriately. 4 is an ordinary pressure wet heat treating chamber of the cloth coming from the bleaching solution tank 2. In the wet heat treating chamber 4, 5 is a means such as a spray or an ultrasonic atomizer for supplying a volatile activation agent in order to make the interior of the chamber 4 acidic. 6 are a plurality of guide rolls provided up and down alternately for transporting the cloth 1 with no tension by forming snaky undulations through the chamber 4 continuously. 7 are heating means to heat the interior of the chamber up to a temperature nearly to 100° C.

The construction of the apparatus in this example is as above described. Now, the function of this apparatus will be stated in the following.

In the first place, a cloth to be bleached 1 is immersed in a bleaching solution comprising a slightly alkaline sodium chlorite solution with a concentration of about 0.5–1.0% in the bleaching solution tank 2 at the ordinary temperature. The cloth soaked with the sodium chlorite solution is squeezed by means of the squeeze roll 3 appropriately, and the thus squeezed cloth is transferred into the wet heat treating chamber 4 which has been heated to a temperature nearly 100° C. previously by using the heating means 7.

In the wet heat treating chamber 4, a volatile activation agent, for instance acetic acid, is supplied in the state of mists by using the means 5 so as to make the atmosphere in the chamber acidic with a pH of 3–4. Instead of acetic acid, such activation agent as an inorganic acid and a carbonyl compound as already mentioned may also be used. The cloth is transported continuously therethrough zigzag forming snaky undulations with no tension by means of the guide rolls 6 at a temperature in the range of 90°–95° C., and thus the continuous bleaching of a long cloth in object is done in a short time of within 2 minutes. The cloth is bleached uniformly and excellently, and particularly with no formation of creases of which formation can by no means be avoided in the conventional art.

EXAMPLE 2

Figure 2:
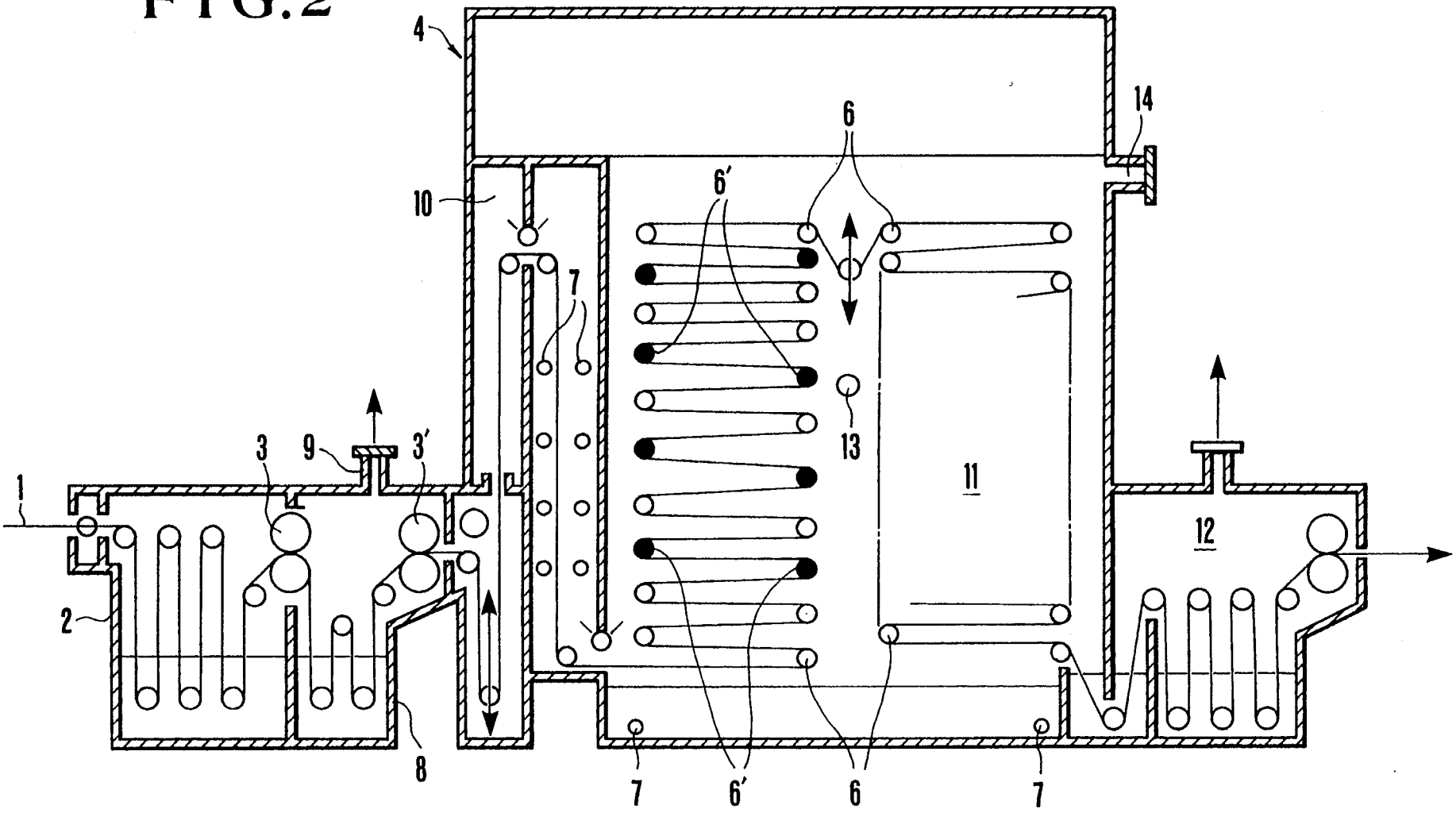
FIG. 2 is another example thereof in the case of using a carbonyl compound as an activation agent.

This example is to show the process in the present invention in which a carbonyl compound is used as an activation agent for making the atmosphere of the wet heat treating chamber acidic. In FIG. 2, 1 is a long cloth to be bleached, 2 is a bleaching solution tank to introduce a sodium chlorite solution at the ordinary temperature similarly as in FIG. 1. In this instance, an activation agent tank 8, which is to introduce an activation agent comprising a carbonyl compound, is provided next to the bleaching solution tank 2. 3 and 3′ are squeeze rolls respectively for squeezing the cloth. 9 is an exit of chlorine dioxide gas accidentally formed in the activation agent tank 8. 4 is a wet heat treating chamber, which is divided in two parts, a heating chamber 10 and a reaction chamber 11. 6 are a plurality of guide rolls provided up and down alternately for transporting the cloth 1 forming snaky undulations continuously with no tension. Among the guide rolls 6, those with the numerical 6′ placed fittingly are water cooled ones for forming water droplets easily on the surface thereof. 7 are a plurality of heating means comprising heating pipes. 12 is a neutralization tank containing a reducing agent solution for neutralizing and removing the solution contained in the cloth bleached. 13 is a sensor for measuring the concentration of chlorine dioxide gas formed from sodium chlorite for the use of bleaching the cloth in the reaction chamber 11. When the concentration of chlorine dioxide gas determined by said sensor 13 becomes too high, its concentration is controlled by opening the exhaust pipe 14.

In carrying out the bleaching of a cloth by using this apparatus, the cloth 1 is immersed in the first place in a sodium chlorite solution in the bleaching solution tank 2 at the ordinary temperature, then the cloth is squeezed by using the squeeze roll 3 and passed, in this instance, further through an activation agent tank containing a carbonyl compound as an activation agent also at the ordinary temperature. The resultant cloth is squeezed again by using the squeeze roll 3', and supplied into the heating chamber 10 of the wet heat treating chamber 4 for heating and beginning the wet heat treatment. The thus heated cloth sufficiently to 70°-90° C. is transferred to the reaction chamber 11, where the cloth is transported continuously by guiding with the use of the guide rolls 6 for continuing the bleaching further. In the reaction chamber, the cloth is contacted occasionally with the guide rolls 6' having dews on the surface thereof. Thus, the dews are transferred to the cloth, and the wet heat treatment of the cloth for the bleaching thereof proceeds more effectively. The cloth bleached sufficiently in this way is neutralized in the neutralization tank 12, and thus a cloth sufficiently bleached is obtained.

In this example, a carbonyl compound is used as an activation agent for making the atmosphere of a wet heat treating chamber acidic, but a carboxyl compound is not an acid in itself. It acts as an activation agent for the first time at a sufficiently elevated temperature, so that a carbonyl compound can be applied to a cloth to be bleached conveniently at the ordinary temperature before the cloth is supplied in a wet heat treating chamber. Therefore, the continuous bleaching of a cloth by using a carbonyl compound as an activation agent can be done more effectively in a wet heat treating chamber at a temperature of 70°-90° C. in a short time of about 30-60 seconds as in this instance.

The practical merit of the present invention will be described in this occasion. Since the bleaching time of a cloth is very short as 30-60 minutes, when the passing speed of the cloth in a practical apparatus is 100 m/rain as already mentioned, it is sufficient that the capacity of the wet heat treating chamber is to introduce 50-100 meters of the cloth therein, and such an apparatus can beneficially be applied for the practical use commercially. In the case even when the bleaching time reaches to 2 minutes as in the case of Example 1, the length of a cloth necessary to stay in a wet heat treating chamber is still only 200 meters, and such a wet heat treating chamber can also be applied for practical use. Therefore, the present inventive apparatus can be applied eminently commercially.

EXAMPLE 3

Figure 3:
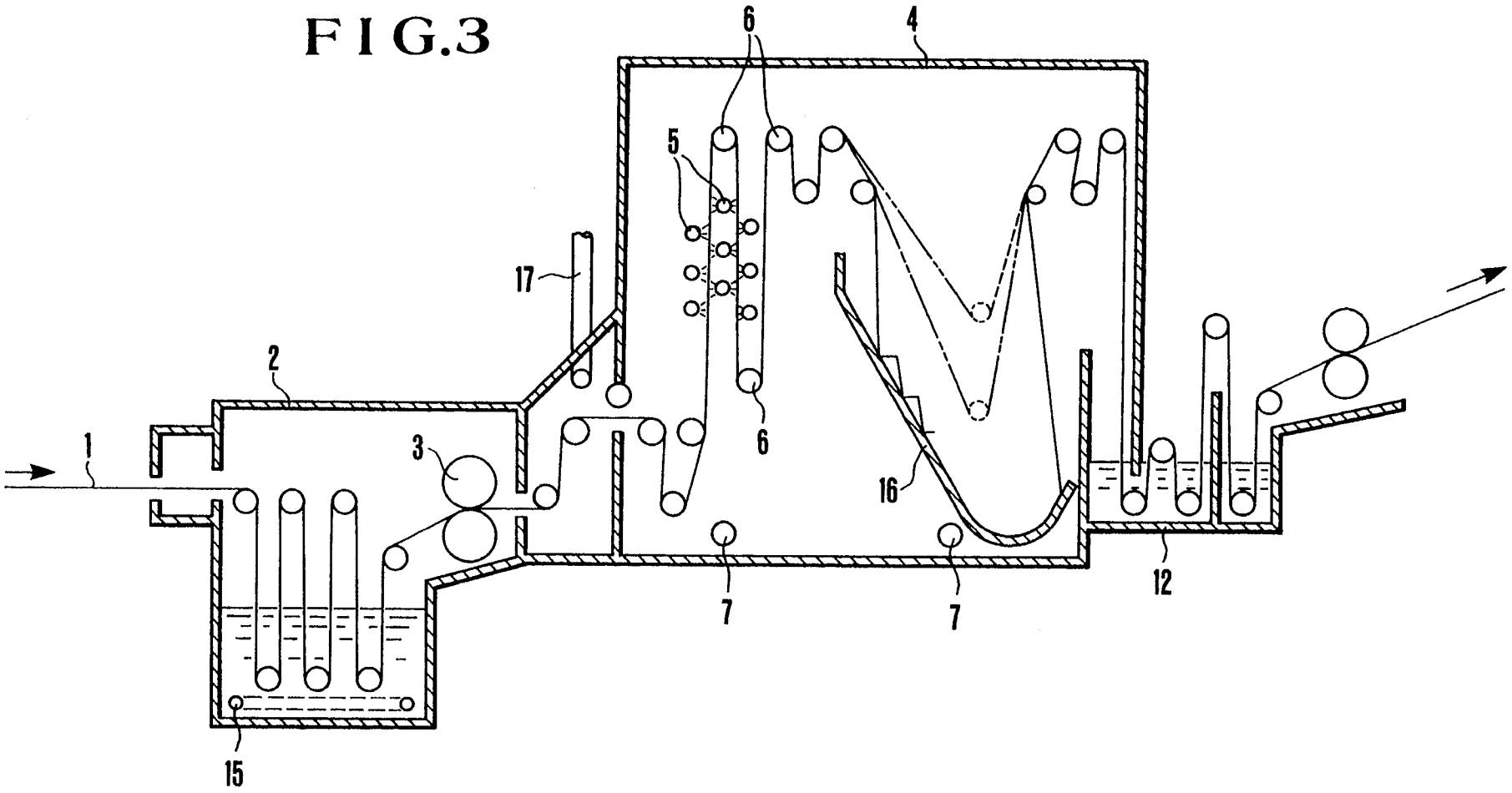
FIG. 3 is an example of the present inventive apparatus in which a piler is added next to the guide rolls in the wet heat treating chamber.

The apparatus in FIG. 3 is for the use of Example 3, in which a piler is provided further next to a series of guide rolls 6 in the wet heat treating chamber 4 for the purpose to carry out the wet heat treatment of the cloth further. Unless otherwise stated, the numerals indicating the parts in the figure are corresponding to the parts with similar numerals in FIGS. 1 and 2 previously mentioned. In addition, 15 is a heating pipe provided in the bleaching solution tank 2 in this example for heating sodium chlorite solution therein previously. 16 is a piler for transporting the cloth 1 further in succession to the guide rolls 6, and 17 is an exhaust pipe provided at the cloth inlet part of the wet heat treating chamber 4.

In tire bleaching solution tank 2, a cloth to be bleached 1 is passed through a sodium chlorite solution with a concentration of 0.5-1.0% at a temperature of 80°-95° C. The cloth is squeezed by using the squeeze roll 3 so as to control the bleaching solution content thereof to about 100%, and then supplied into the wet heat treating chamber 4. In the wet heat treating chamber, an activation agent solution comprising an acid, a carboxyl compound, or a mixture of them is added to the cloth by the use of such means as a spray or an ultrasonic atomizer 5 in an amount 0.2-0.5% to the cloth. The cloth is then transported continuously through the chamber by using a plurality of guide rolls 6 and the piler 16. Thus, the bleaching of a cloth in object is accomplished in a short time of 30-60 seconds satisfactorily.

EXAMPLE 4

Figure 4:
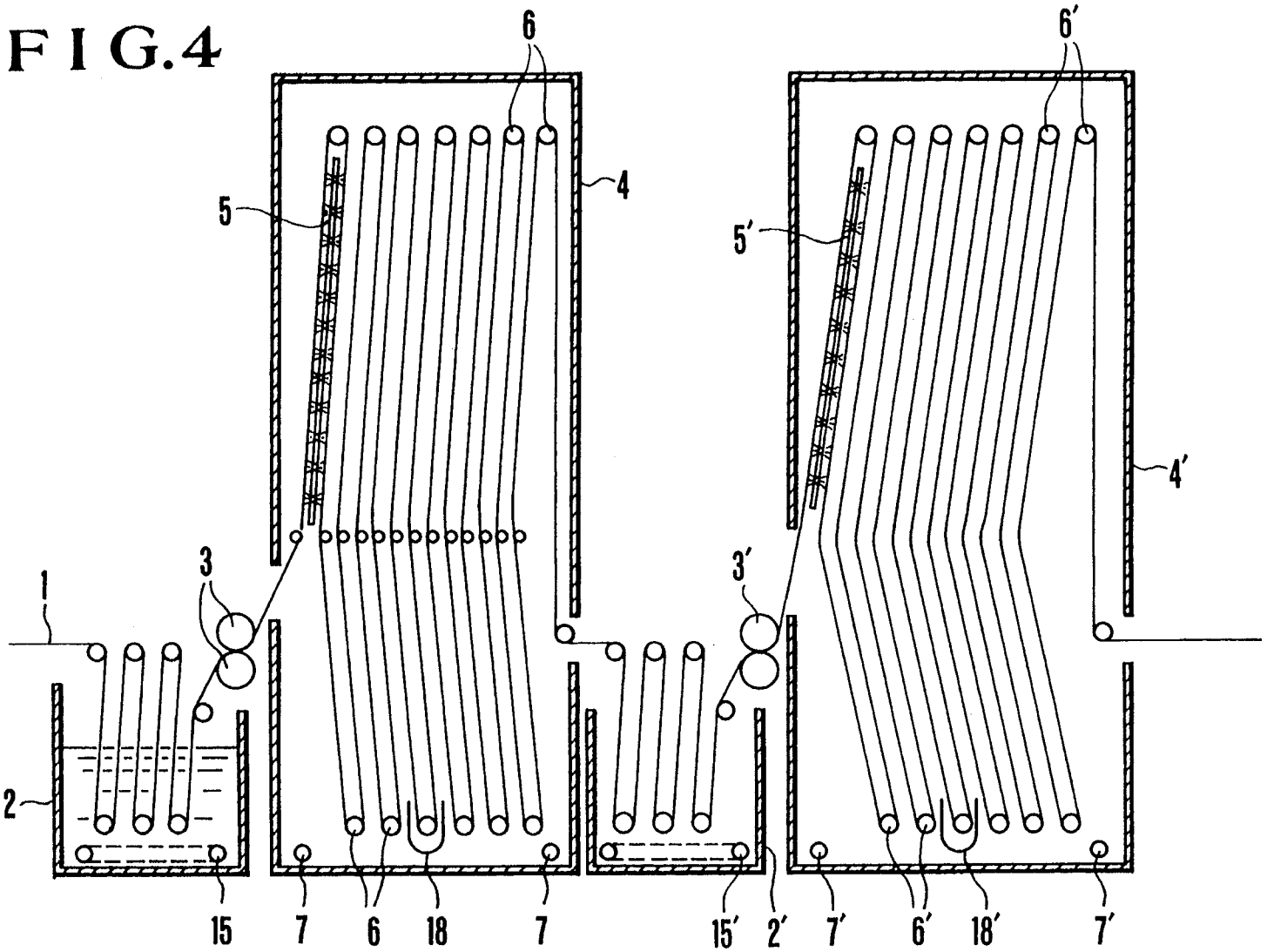
FIG. 4 is to show an apparatus for carrying out the wet heat treatment in two steps in succession.

This example is to show an case in which the bleaching is done in two steps with the use of two wet heat treating chambers in succession in an apparatus as shown in FIG. 4.

In FIG. 4, a first wet heat treating chamber 4 fitted with a bleaching solution tank 2 is connected to a second wet heat treating chamber 4' also fitted with a bleaching solution tank 2'. The numerals indicating the parts in this figure are corresponding to the parts with similar numerals in the previous figures, and boosters 18 and 18' are attached to each one of the guide rolls respectively in the two wet heat treating chambers. The number of the wet heat treating chamber is not limited to two, and more than two chambers may also be applied.

In carrying out the bleaching of a cloth 1 in this example, a cloth to be bleached 1 is immersed in a slightly alkaline sodium chlorite solution at a temperature of 60°-95° C. heated by means of the heating pipe 15, and squeezed by using the squeeze roll 3 for removing excess solution. The cloth is then supplied into the first wet heat treating chamber 4 maintained at a temperature of about 100° C. by using the heating means 7. In the wet heat treating chamber 4, the cloth receives an activation agent solution to make the atmospheric of the chamber acidic by using the means for supplying the same 5, and is transported through the chamber similarly as in the preceding examples. In this example, particularly, moisture is supplemented to the cloth always by means of the boosters 18 and 18' so as to accelerate the bleaching more effectively. The cloth is then transferred to the second wet heat treating chamber 4', and treated as before.

In this example, the total amount of sodium chlorite consumed is about 0.6-0.8% per the cloth treated, and the bleaching time is only about 1-2 minutes in total even when the cloth is hardly bleachable. Therefore, this apparatus is particularly suitable for the bleaching of such a hardly bleachable cloth.

What is claimed is:

1. A method for bleaching a cloth, comprising soaking a cotton containing cloth with an aqueous bleaching solution containing sodium chlorite and subjecting the cloth thus soaked to a wet heat treatment in an atmosphere acidified by addition of an activation agent selected from the group consisting of sulfuric acid, hydrochloric acid, formic acid, acetic acid, formaldehyde and acetaldehyde, so as to form chlorine dioxide active for the bleaching of the cloth by decomposition of sodium chlorite wherein the wet heat treatment is carried out for a period of two minutes or less.

2. A method for bleaching a cloth described in claim 1, wherein the cloth soaked with sodium chlorite solution as a bleaching solution is subjected to a wet heat treatment continuously in an ordinary pressure wet heat treating chamber of which atmosphere is acidified to a pH of 3-4 by the addition of an activation agent.

3. A method for bleaching a cloth described in claim 1, wherein the cloth soaked with sodium chlorite solution as a bleaching solution is immersed further in an activation agent solution comprising a carbonyl compound, and the resultant cloth is subjected to wet heat treatment continuously at a temperature of 90°–95° C. in a wet heat treating chamber of which atmosphere is acidified to a pH of 3–4 due to the effect of the activation agent previously applied.

4. A method for bleaching a cloth described in claim 1, characterized in that the soaked cloth is bleached continuously by repeating the wet heat treatment in a plurality of ordinary pressure wet heat treating chambers.

5. The method of claim 1 wherein the time period is from 30 to 60 seconds.

* * * * *